US007018115B2

(12) United States Patent
Evans et al.

(10) Patent No.: US 7,018,115 B2
(45) Date of Patent: Mar. 28, 2006

(54) WASHING METHOD AND APPARATUS

(75) Inventors: Gareth B. Evans, Hertfordshire (GB); Peter Hewitson, Middlesex (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/649,487

(22) Filed: Aug. 26, 2003

(65) Prior Publication Data

US 2004/0042788 A1 Mar. 4, 2004

(30) Foreign Application Priority Data

Aug. 31, 2002 (GB) ..... 0220261

(51) Int. Cl.
*G03D 5/00* (2006.01)
*G03D 3/08* (2006.01)

(52) U.S. Cl. ..... 396/604; 396/612; 396/627; 355/27

(58) Field of Classification Search ..... 396/604–606, 396/627, 636, 617, 620; 355/27–29
See application file for complete search history.

(56) References Cited

U.S. PATENT DOCUMENTS 4,977,422 A * 12/1990 Vaughan, IV ..... 396/605
5,357,305 A * 10/1994 Long ..... 396/605
6,106,169 A 8/2000 Adam et al.

FOREIGN PATENT DOCUMENTS

EP 0 908 767 4/1999

* cited by examiner

*Primary Examiner*—D. Rutledge
(74) *Attorney, Agent, or Firm*—Frank Pincelli

(57) ABSTRACT

An apparatus for washing contaminants from a coated surface of a material comprises an inclined substantially planar surface up which the material is passed, an inlet for the introduction of wash solution at the upper part of the planar surface and pressure applying means for holding the material in full contact with the surface.

15 Claims, 3 Drawing Sheets

WASHING METHOD AND APPARATUS

CROSS REFERENCE TO RELATED APPLICATIONS

This is a U.S. original patent application which claims priority on Great Britain patent application No. 0220261.2 filed Aug. 31, 2002.

FIELD OF THE INVENTION

This invention relates to the washing of sheets of material which contain substances requiring washing for their removal. The invention relates in particular to the washing or stabilization stage of the photographic processing of color film and paper. The invention will be described with reference to a system for washing photographic paper.

BACKGROUND OF THE INVENTION

There is a need in the photographic industry to remove substances from processed material to ensure image stability. In deep-tank replenished processing systems material passes from one tank to the next. For example, with respect to processing of color paper, the material passes through a first tank for development, a second tank for bleach/fix and then into a series of wash or stabilizer tanks. The wash tanks are usually inter-connected so that clean washing solution is added to the last of the tank series and the over-flow from the last tank is transferred to the previous tank and so on. In this way the flow of solution is in a direction which is counter to the direction of transport of the paper. This so-called counter-current flow technique enables efficient washing since when the material has the highest content of substances to be removed, the wash solution also has the highest concentration of removed substances and clean solution is only used in the last step when the processed material contains little removable contaminants.

The table below is derived from a mathematical model which predicts the fraction of contaminants remaining in color paper after a four-tank counter-current wash stage in which 194 ml/m$^2$ of solution is added to the last tank. High agitation is assumed which allows equilibrium between substances in the solution and processed material to be rapidly established.

| Counter-Current Multiple Wash | | |
|---|---|---|
| Number of tanks | 4 | 4 |
| Fraction of material left | 0.00067 | 0.00062 |
| Total Volume (ml per m$^2$) | 194 | 776 |
| Total time @ 22.5 sec per tank | 90 | 90 |

The technique of counter-current washing is widely if not universally adopted with small, so-called Minilab or Microlab equipment and is often also used in large-scale wholesale equipment. More efficient washing can be achieved if more tanks are used in a counter-current series. However, the tanks are bulky and require pumps to provide adequate re-circulation and agitation. Each additional tank incurs additional cost and maintenance.

Shorter washing times can be achieved if the time in each tank is reduced below that required for the material in the coating to be in equilibrium with the material in solution. This can be achieved without undue loss of washing efficiency. For example U.S. Pat. No. 6,106,169 describes a multi-tank unit in which all but the last tank is insufficiently long to provide an immersion time sufficient to reach equilibrium. This unit was found to produce good results with a seven tank configuration giving a total wash-stage time of 20 seconds using as little as 9 ml/m$^2$ of solution.

By reducing the tank volumes, shaping them appropriately and allowing the paper to be transported with the coated side against the curved surface of the interior of the tanks, the agitation/re-circulation pumps could be avoided. However this arrangement required the provision of seven tanks with six cross-over devices to pass the paper from one tank to the next. Such cross-over devices, usually a set of at least two rollers, are expensive and require cleaning and maintenance.

An alternative approach to using curved surfaces in the above multi-stage unit is to use substantially planar, inclined surfaces. The so-called "Inclined Ramp" washing system, see EP M908767, provided a single plane at a 45° angle, to guide the paper in an upward direction with the coated side of the paper against the plane surface. Cleaning/washing solution was added to the top of the inclined plane and ran under gravity under the paper. This surface was not smooth but was textured to provide some agitation. Theoretically this provides a very large number of tanks in a way which is analogous with the theoretical plates of a distillation column. Although each "tank" provides inefficient washing due to the short residence time, the opportunity for material exchange between the paper and increasingly clean water is continuously available. In practice, the efficiency of this device was not high. This was possibly due to the ability of the wash solution to find pathways under the paper surface which allowed rapid descent of a substantial part of the solution. Also in this type of arrangement, it is possible for the paper to drag water from the lower end of the ramp where the solution contains high concentrations of extracted substances to the upper parts, thus contaminating the relatively clean solution flowing down the surface. A number of these problems have been solved, see co-pending application ref 84588, having the same filing date as this application. The problems were solved by providing a planar surface which differs from a truly smooth continuous planar surface in a way which provides a means of controlling the descent of wash solution down the inclined plane so that the descent time of the wash solution is substantially longer than the descent time of the same solution on a smooth planar surface. The preferred rate of descent of the solution is between 0.05 and 10 times the rate of ascent of the paper.

An apparatus based on this principle provides excellent washing which is both rapid and which makes efficient use of wash solution. However some difficulties were encountered.

The paper must be held against the planar surface over its whole area and must be transported up the plane, preferably by simple mechanical means. The paper is often provided in the form of sections of a continuous web of material which is usually manufactured in roll form. The sheets or webs of paper therefore do not naturally lie flat and are subject to strains introduced while in roll form. There is a tendency for the paper to curl and this tends to lift the paper from the planar surface at all four edges.

A rigid support may be applied to the back of the paper in order to apply a force pressing the paper against the plane. However, it is difficult to ensure even pressure without either precise engineering or complicated adjustable locating means whilst also ensuring that the paper can be transported against the resistance provided by the frictional forces produced by the applied pressure. Also, a smooth surface, particularly when wet, provides excessive drag.

It is also important to clean the back of the paper. Contaminants from the processing baths before the wash stage will be present in a film of liquid on the back of the paper. These need to be removed. In addition, contaminants will be transferred to the surface of the means of applying pressure to the back of the paper. The motion of the paper up the plane tends to drag the dirty liquid up the plane. When a length of paper has passed through the wash stage, the surface of the means of applying pressure will tend to contact the washing surface of the inclined plane and contamination of the clean areas of the plane occurs.

The problem to be solved is the application of pressure to the back of the paper in such a way as to ensure contact of the coated surface of the paper with the washing surface over the entire area of the paper whilst allowing the frictional resistance to paper transport to remain sufficiently low as to allow transport to be achieved with the minimal use of paper drive mechanisms, such as rollers or belts. Additionally, the back of the paper and the means of applying pressure must be cleaned in a way which prevents the washing surface being contaminated by waste material transferred from the means of applying pressure when paper is no longer present.

SUMMARY OF THE INVENTION

According to the present invention there is provided an apparatus for washing substances from a coated surface of a material, the apparatus comprising at least one inclined substantially planar surface up which the material is passed, an inlet for the introduction of wash solution being provided at the upper part thereof, and pressure applying means for holding the material in full contact with the planar surface.

Preferably the pressure applying means comprises a flexible member lying on top of the material being washed. This flexible member preferably has a textured surface.

The invention further provides a method of washing substances from the coated surface of a material, the material being transported up at least one inclined substantially planar surface and wash solution being introduced at the upper part of the inclined planar surface between the planar surface and the material, the material being held in full contact with the planar surface by the application of pressure to the back thereof.

Preferably wash solution is also introduced between the material and the pressure applying means.

The invention provides efficient and rapid washing. The present invention ensures that the entire surface of the processed material is efficiently washed. The present invention further provides that the washing surface of the planar surface is not contaminated by the substances carried into the wash stage on the back of the material.

BRIEF DESCRIPTION OF THE DRAWINGS

The invention will now be described, by way of example, with reference to the accompanying drawings, in which.

DETAILED DESCRIPTION OF THE INVENTION

Figure 1:
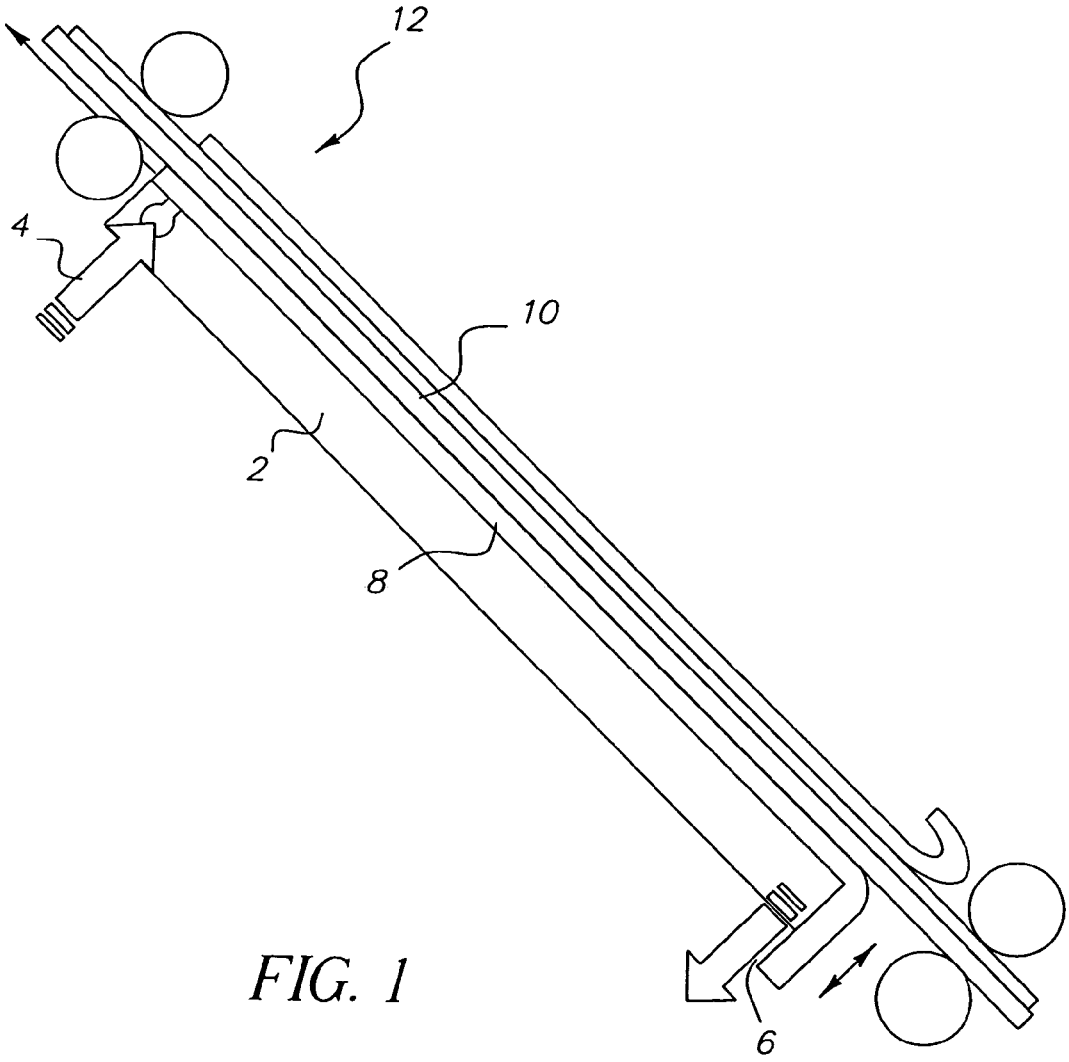
FIG. 1 is a schematic view of an embodiment of the invention.

FIG. 1 is a schematic view of an embodiment of the invention.

Referring to FIG. 1 there is provided a substantially planar inclined surface 2. An inlet 4 for the introduction of fresh wash solution is located at the upper end of the inclined surface 2. An outlet 6 for the dirty wash solution is located at the lower end of the surface 2. In the embodiment illustrated the surface is covered with a material such as fabric. This fabric cover 8 provides resistance to flow in the plane of the fabric by soaking up the wash solution within the fibers. The fabric cover is a preferred feature and is not essential to the present invention. A flexible member 12 is provided above the material to be washed, hereinafter referred to as paper 10, such that it lies on the back thereof. The member 12 is fixed across its width at the lower end of the surface 2. This end of the member may be curved to facilitate the feeding of paper between the member and the surface 2. The member may also be fixed at the upper end of the surface but this is not essential. The flexible member 12 is of sufficient weight to rest on the paper and make the paper conform to the surface of the inclined plane but not to prevent transportation of the paper up the planar surface. The whole width of the paper is held against the planar surface by the weight of the member 12. The member could, for example, be made of a PVC based material or of silicone rubber material Rollers or other transportation means, not shown, convey the paper to be washed up the inclined surface. The paper may be in sheet form or be a continuous web of coated material. It is preferable for the surface of the flexible member 12 in contact with the paper to be textured. Such a surface reduces resistance to movement of the paper. It is also preferable that the textured surface is such that the highest points of the surface are in a continuous plane, i.e. the surface consists of a plurality of indentations below a planar surface rather than protrusions above a planar surface.

The degree of pressure applied and the resistance to paper transport can be controlled by reducing the area of the flexible member. This could be done, for example, by cutting out circular holes. Other ways of reducing the area will be apparent to those skilled in the art. The stiffness of the flexible member will also be affected by cutting out holes. Additional weight and stiffness can be provided by attaching more rigid material to the back of the flexible member. This could, for example, be effected by placing rigid strips of material across the member 12 transverse to the direction of travel of the paper.

In operation the paper 10 is transported up the inclined planar surface 2, beneath the flexible member 12. The paper is fed up the surface with the coated surface thereof in contact with the surface 2. The wash solution is fed through the inlet 4 and flows downwards under gravity towards the outlet 6 under the paper 10. As the wash solution passes down the inclined surface the contaminants leave the paper and are transferred to the wash solution. The contaminated wash solution passes through outlet 6. During this process the paper 10 is held against the inclined surface 2 by the weight of the flexible member 12. As the whole area of the paper is thus in contact with the planar surface more efficient washing is enabled.

In a preferred embodiment of the invention wash solution is also introduced at the upper part of the inclined plane 2 between the paper 10 and the member 12. This effectively washes contaminants off the back of the paper and thus off the surface of the flexible member in contact with the back of the paper. This ensures that when the paper has passed from the washing area there are substantially no contaminants left on the surface of the flexible member. Thus the inclined surface doe not become contaminated by contact with the flexible member. The wash solution is removed further down the plane, not illustrated. The experiment described below illustrates the results found on using a preferred embodiment of the invention.

An experimental 8-inch wide unit was constructed and evaluated. The unit is illustrated in FIG. 1. The fabric chosen for the cover 8 was velvet supplied by the specialist US fabric manufacturer Milliken and is the same as that used in 35 mm film cassettes. The plane 2 was inclined at an angle of 27 degrees to the horizontal. The flexible member used to hold the paper against the surface of the felt is made from a PVC conveyor belt material produced by Ammeraal Process and Conveyor Belting (Flexam 1T3240). It has pyramidal dimples embossed into the surface in contact with the back of the paper. These help to reduce friction. The belt material had 30 mm holes punched through it, to improve the flexibility further and to reduce the drag on the back surface of the paper.

Figure 2:
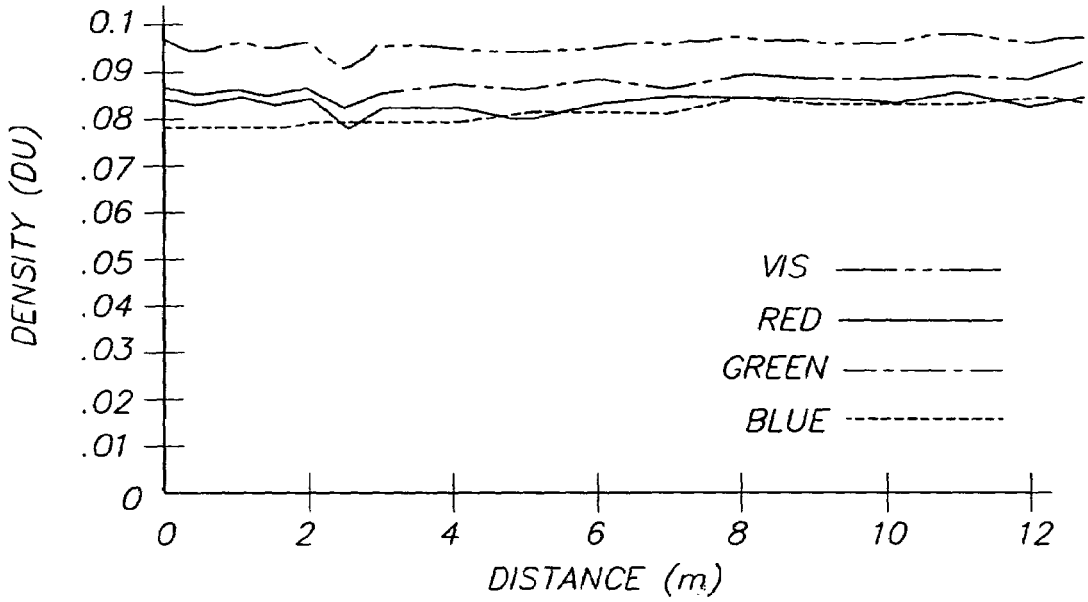
FIG. 2 is a graph showing density of the washed paper against distance along the planar surface.

Ektacolor Edge8 paper was passed through a standard deep tank Ektacolor Prime developer and Bleach-fix (22 s in each tank) before progressing up the ramp. The developer and bleach-fix were heated to 35° C., whilst the wash was at room temperature (22° C.). A simple wash solution of 2 g/l Kodak Photoflo solution was applied to the inclined plane at a rate of 18 ml/min. As the paper is transported up the plane at a rate of 3 linear feet a minute, this equates to a solution usage rate of 9 ml/ft$^2$. The incline takes about five minutes to prime. Therefore it holds approximately 90 ml of liquid, in a film about 0.75 mm thick, within the velvet. The incline was run continuously for fifteen minutes and thus experienced at least three tank turnovers of solution. Samples were taken from the paper at intervals and the paper minimum density was measured. These results are shown in FIG. 2.

Figure 3:
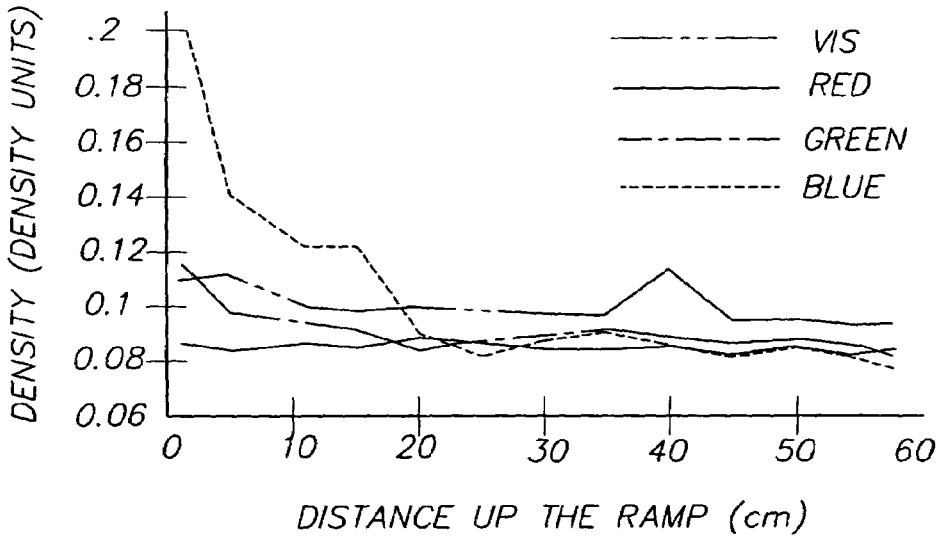
FIG. 3 is a graph showing the concentration profile of retained substances along the planar surface.

At the end of the fifteen minute run the final piece of paper on the incline was removed and dried. By measuring the density of this piece of paper a simplified assessment of the concentration profile of retained products on the ramp could be obtained. This density profile is given in FIG. 3. This data shows most material has been removed by the time the paper has climbed 25 cm up the incline.

Figure 4:
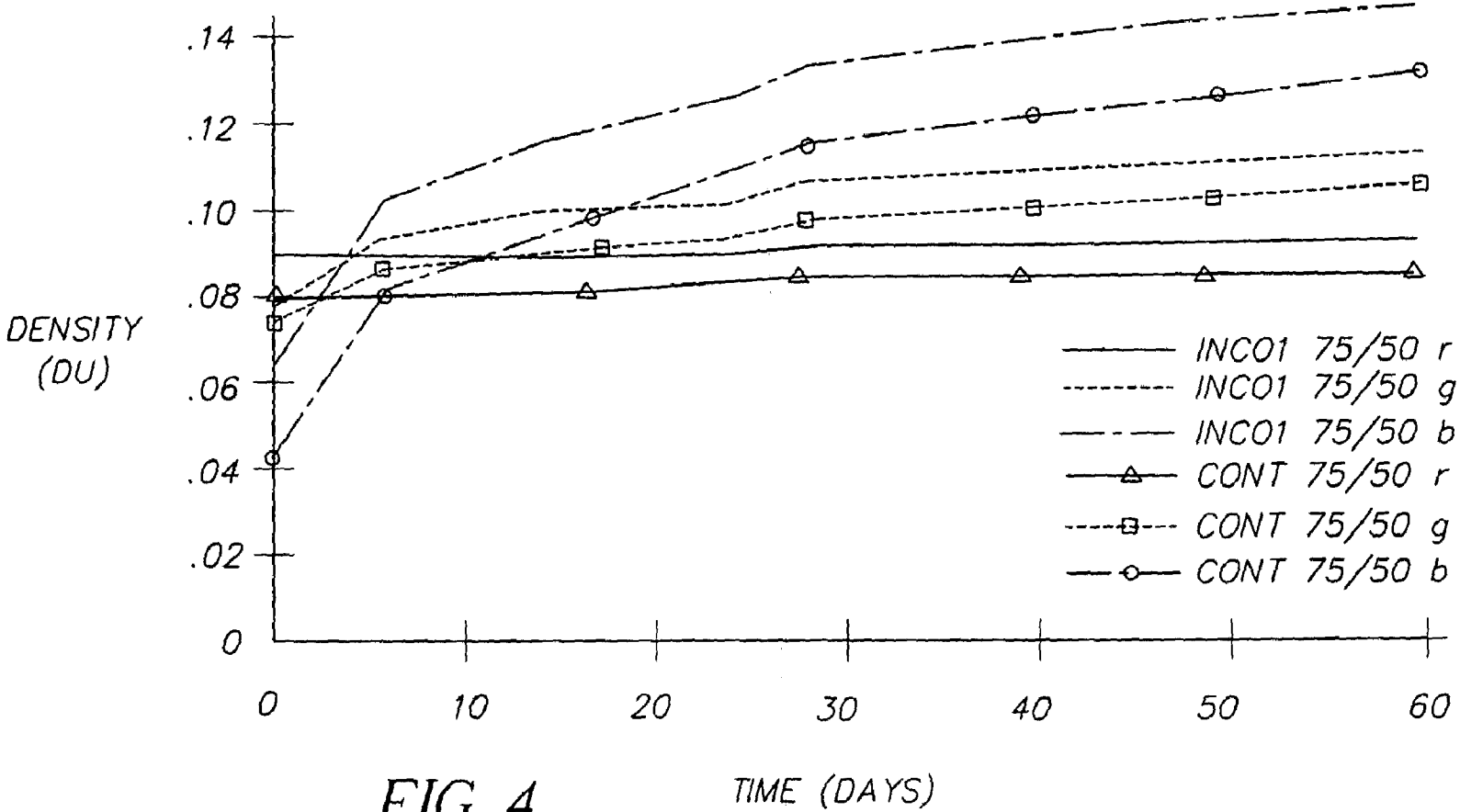
FIG. 4 is a graph comparing the densities of a sample of paper washed by the present invention and a sample of paper washed in a continuous flow of water.

Finally, a sample of paper washed in the inclined plane was compared with a sample washed in a continuous flow of tap water for five minutes. The samples were placed in dark wet fade incubation ovens at 75C/50% RH to check for any effects caused by retained CD3. The results can be seen in FIG. 4.

Both samples showed a similar increase in minimum density values. No significantly greater increase in density was seen for the inclined plane washed sample therefore no CD3 was present in this sample. This was also confirmed using a basic reducing agent.

It is to be understood that various modifications and changes may be made without departing from the present invention, the present invention being defined by the following claims.

| PARTS LIST | |
|---|---|
| 2 | inclined surface |
| 4 | inlet |
| 6 | outlet |

-continued

| PARTS LIST | |
|---|---|
| 8 | cover |
| 10 | paper |
| 12 | flexible member |

What is claimed is:

1. Apparatus for washing substances from a coated surface of a material, the apparatus comprising at least one inclined substantially planar surface up which the material is passed, an inlet for the introduction of wash solution being provided at the upper part thereof, and pressure applying means for holding the material in full contact with the planar surface.

2. Apparatus as claimed in claim 1 wherein the pressure applying means comprises a flexible member lying on top of the material.

3. Apparatus as claimed in claim 1 wherein the pressure applying means has a textured surface.

4. Apparatus as claimed in claim 1 wherein the pressure applying means is more flexible in one direction than in the other.

5. Apparatus as claimed in claim 1 wherein the weight of the pressure applying means is non uniform over the area thereof.

6. Apparatus as claimed in claim 1 wherein the planar surface incorporates substantially non smooth resistance means providing a resistance to downward flow of the wash solution and having a capacity to hold wash solution in excess of that of a substantially smooth surface.

7. Apparatus as claimed in claim 1 wherein the width of the pressure applying means is greater than the width of the material to be washed.

8. Apparatus as claimed in claim 1 wherein the member is made of a PVC based material.

9. Apparatus as claimed in claim 1 wherein the member is made of a silicone rubber material.

10. Apparatus as claimed in claim 1 for use with photographic materials.

11. A method of washing substances from the coated surface of a material, the material being transported up at least one inclined substantially planar surface and wash solution being introduced at the upper part of the inclined planar surface between the planar surface and the material, the material being held in full contact with the planar surface by the application of pressure to the back thereof.

12. A method as claimed in claim 11 wherein wash solution is further introduced between the material and the means applying pressure to the back thereof.

13. A method as claimed in claim 11 wherein a flexible member provides the pressure applying means.

14. A method as claimed in claim 11 wherein the planar surface incorporates substantially non smooth resistance means providing a resistance to downward flow of the wash solution and having a capacity to hold wash solution in excess of that of a substantially smooth surface.

15. A method as claimed in claim 11 wherein photographic material is being washed.

* * * * *